US005299809A

United States Patent [19]

Evangelista et al.

[11] Patent Number: 5,299,809

[45] Date of Patent: Apr. 5, 1994

[54] NAVAL BATTLE TOY APPARATUS

[76] Inventors: Louis J. Evangelista, 51 Rivington Ave.; Louis J. Evangelista, Sr., 235 Hilman Ave., both of Staten Island, N.Y. 10314; Michael Evangelista, 17 Silvia St., Staten Island, N.Y. 10312

[21] Appl. No.: 9,030

[22] Filed: Jan. 26, 1993

[51] Int. Cl.[5] ..... F41J 5/00

[52] U.S. Cl. ..... 273/380; 273/384; 446/6; 446/24

[58] Field of Search ..... 273/357, 351, 314, 380, 273/383, 384, 127 A, 129 S, 129 T, 405; 446/4, 6, 24, 25

[56] References Cited

U.S. PATENT DOCUMENTS 1,226,551 5/1917 MacPherson ..... 273/357
1,287,768 12/1918 Schanschieff ..... 446/25
2,558,257 6/1951 Kozpnick ..... 446/4 X
2,627,853 2/1953 Koepnick ..... 446/473 X
4,145,049 3/1979 Papazian, Sr. ..... 273/351

FOREIGN PATENT DOCUMENTS 499411 11/1954 Italy ..... 273/380

*Primary Examiner*—Mickey Yu
*Attorney, Agent, or Firm*—Leon Gilden

[57] ABSTRACT

A first and second boat member are provided, with the first member including a spring actuated torpedo directed through the hull of the first toy member arranged to engage and impact a target plate of a second boat member. Upon impact of the target plate, simulation smoke and the ejection of a stacked housing column of plates is projected from the second boat member. Impact of the target plate effects the rotation of a cam plate to impact the housing plates.

3 Claims, 4 Drawing Sheets

FIG. 3
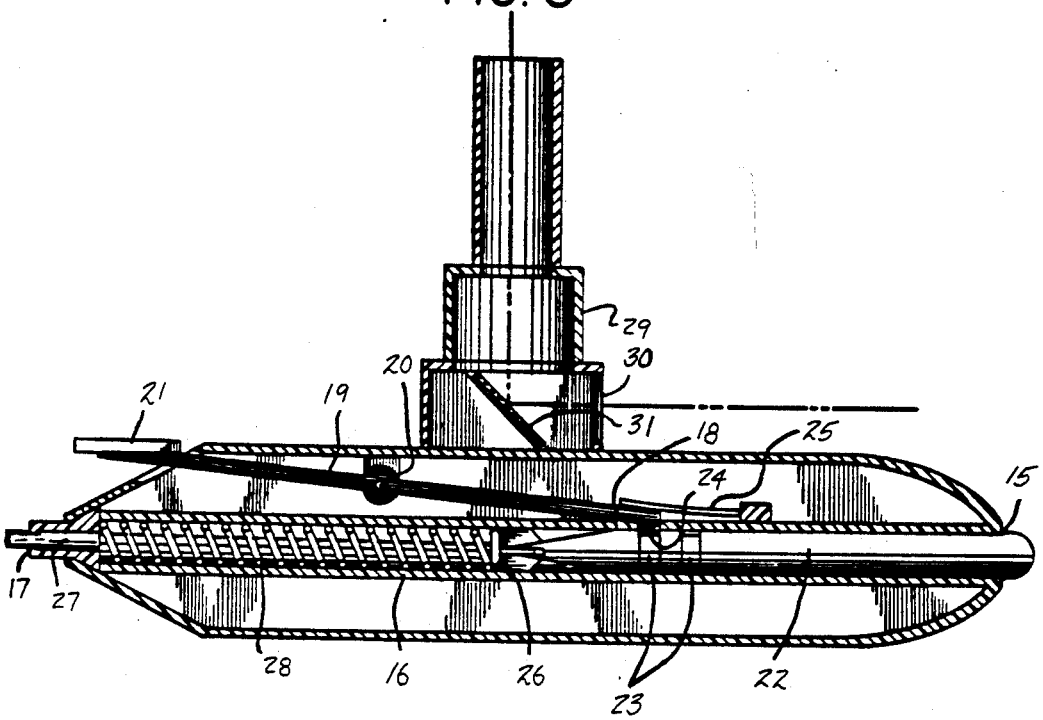
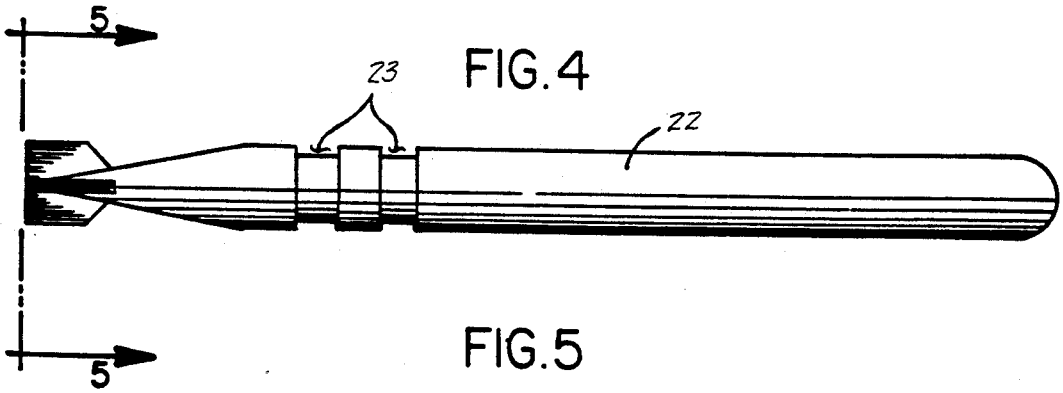
FIG. 4
FIG. 5
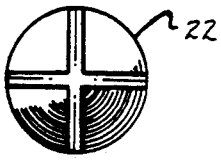

FIG. 8
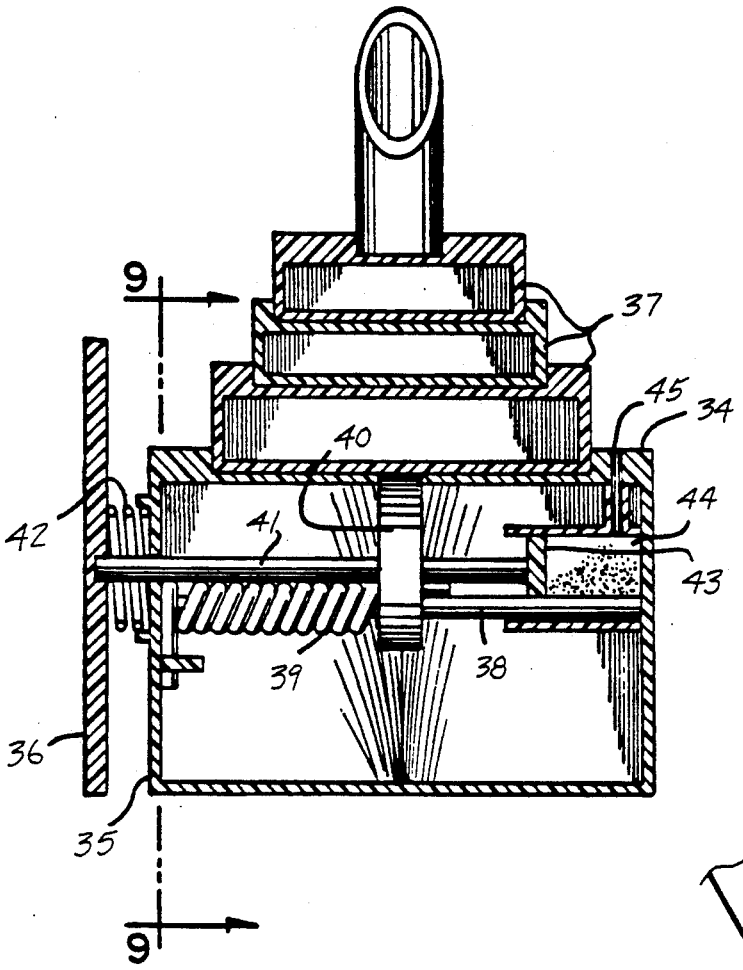
FIG. 9
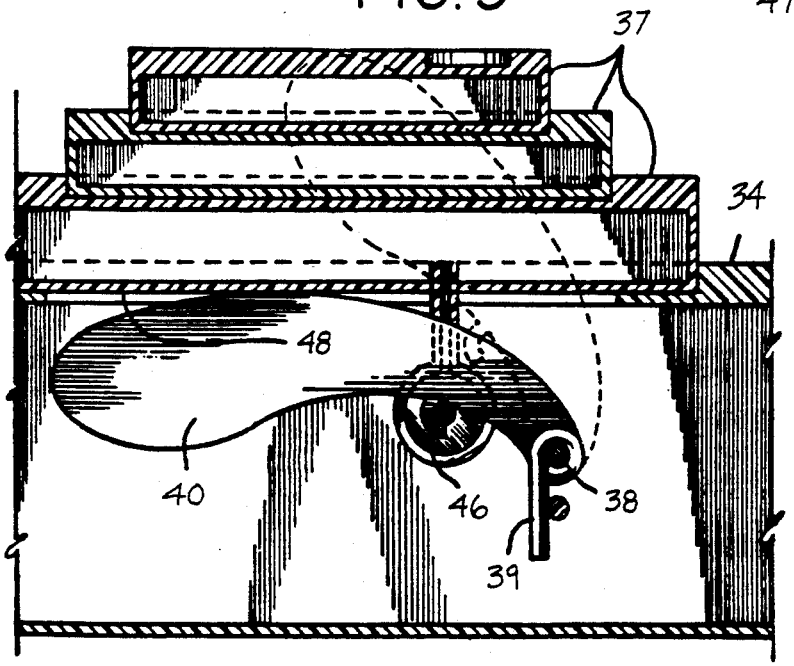
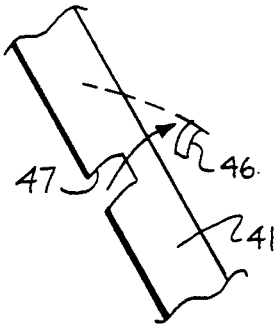
FIG. 9A

NAVAL BATTLE TOY APPARATUS

BACKGROUND OF THE INVENTION

1. Field of the Invention

The field of invention relates to toy apparatus, and more particularly pertains to a new and improved naval battle toy apparatus wherein the same is arranged to simulate a submarine and ship warfare scenario.

2. Description of the Prior Art

Toy ship apparatus is indicated in the U.S. Pat. Nos. 3,419,997; 3,451,159; and 3,395,665.

The instant invention attempts to overcome deficiencies of the prior art by employing a plurality of ship members arranged to act in concert to simulate a naval battle and in this respect, the present invention substantially fulfills this need.

SUMMARY OF THE INVENTION

In view of the foregoing disadvantages inherent in the known types of naval battle toy structure now present in the prior art, the present invention provides a naval battle toy apparatus wherein the same is arranged to employ a submarine simulation and a battleship simulation to provide for the simulation of impact of a torpedo to the battleship simulation member. As such, the general purpose of the present invention, which will be described subsequently in greater detail, is to provide a new and improved naval battle toy apparatus which has all the advantages of the prior art naval battle toy apparatus and none of the disadvantages.

To attain this, the present invention provides a first and second boat member, with the first member including a spring actuated torpedo directed through the hull of the first toy member arranged to engage and impact a target plate of a second boat member. Upon impact of the target plate, simulation smoke and the ejection of a stacked housing column of plates is projected from the second boat member. Impact of the target plate effects the rotation of a cam plate to impact the housing plates.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved naval battle toy apparatus which has all the advantages of the prior art naval battle toy apparatus and none of the disadvantages.

It is another object of the present invention to provide a new and improved naval battle toy apparatus which may be easily and efficiently manufactured and marketed.

It is a further object of the present invention to provide a new and improved naval battle toy apparatus which is of a durable and reliable construction.

An even further object of the present invention is to provide a new and improved naval battle toy apparatus which is susceptible of a low cost of manufacture with regard to both materials and labor, and which accordingly is then susceptible of low prices of sale to the consuming public, thereby making such naval battle toy apparatus economically available to the buying public.

Still yet another object of the present invention is to provide a new and improved naval battle toy apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic cross-sectional illustration of the first boat member.

FIG. 4 is an enlarged orthographic view of the projectile structure.

FIG. 5 is an orthographic view, taken along the lines 5—5 of FIG. 4 in the direction indicated by the arrows.

FIG. 8 is an orthographic cross-sectional illustration of the second boat member.

FIG. 9 is an orthographic view, taken along the lines 9—9 of FIG. 8 in the direction indicated by the arrows.

FIG. 9*a* is an enlarged isometric illustration of the piston shaft structure and its association relative to the cam plate hook.

DESCRIPTION OF THE PREFERRED EMBODIMENT

Figure 1:
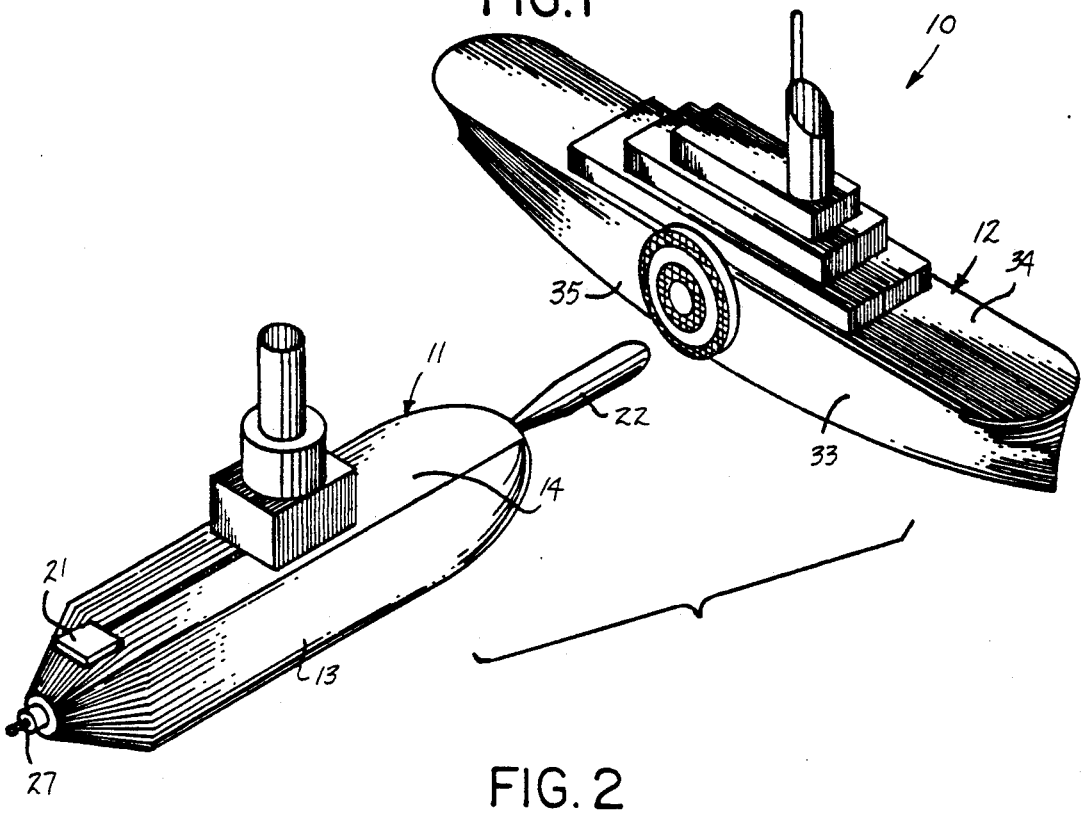
FIG. 1 is an isometric illustration of the invention.
Figure 2:
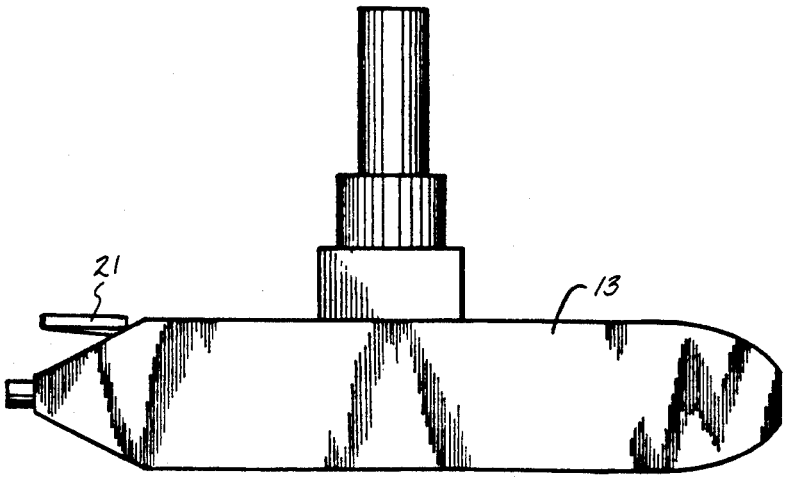
FIG. 2 is an orthographic side view of the first boat member.
Figure 6:
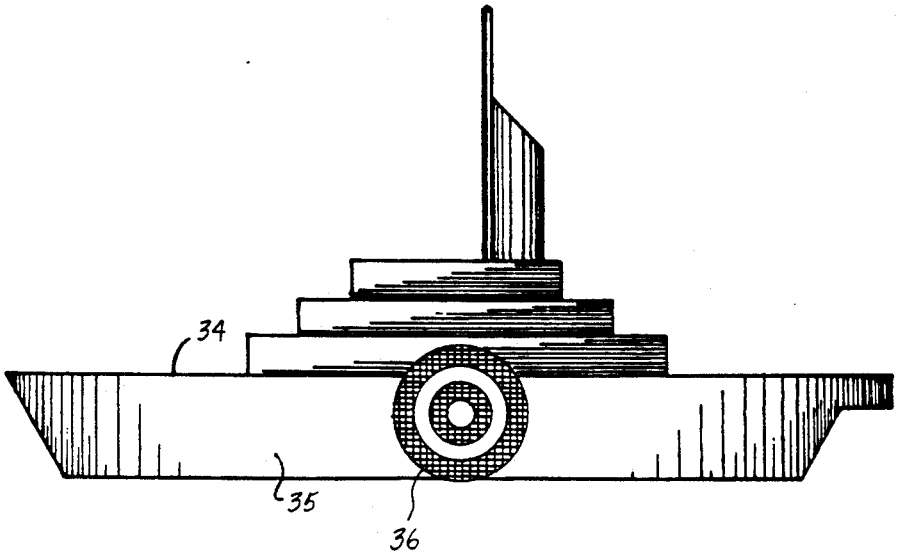
FIG. 6 is an orthographic side view of the second boat member.
Figure 7:
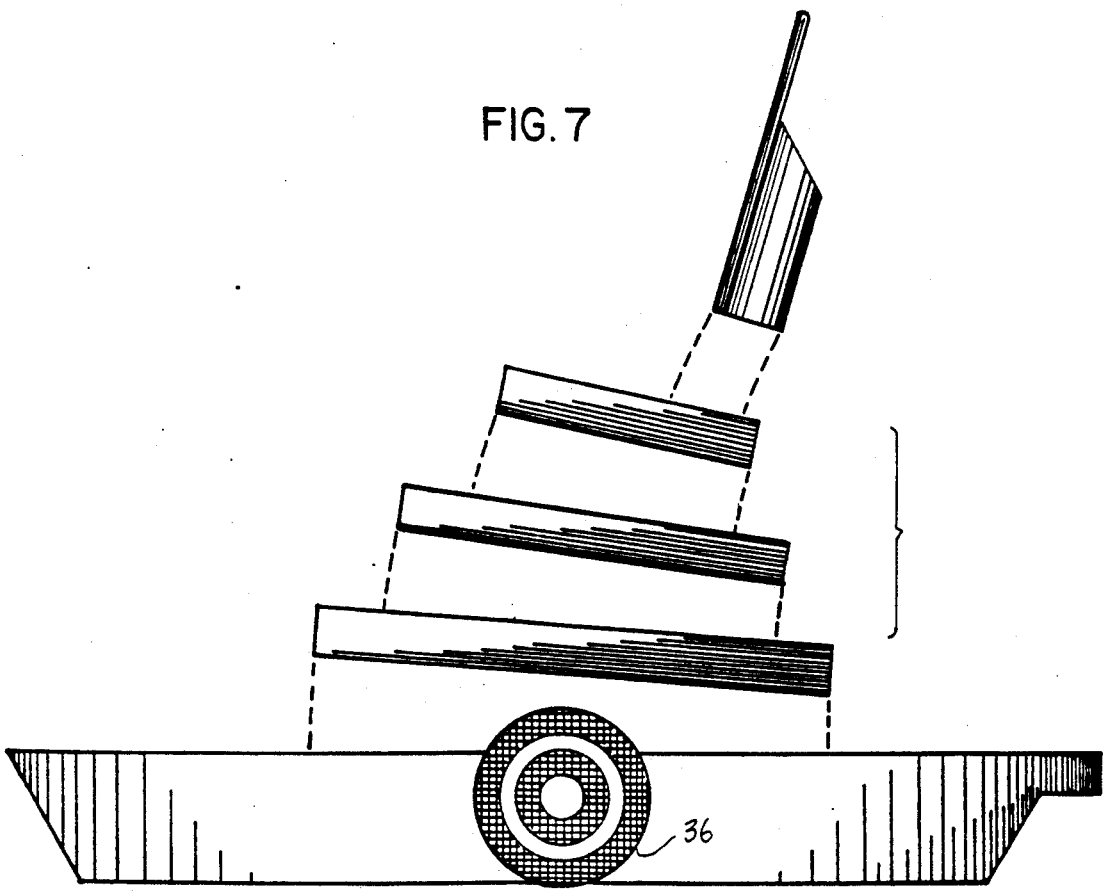
FIG. 7 is an isometric illustration of the second boat member upon impact of the target plate.

With reference now to the drawings, and in particular to FIGS. 1 to 9*a* thereof, a new and improved naval battle toy apparatus embodying the principles and concepts of the present invention and generally designated by the reference numeral 10 will be described.

More specifically, the naval battle toy apparatus 10 of the instant invention essentially comprises a first boat member 11 having an elongate first hull 13, with a second boat member 12 having an elongate second hull 33. The elongate first hull 13 includes a first hull top wall 14, with a first end opening 15 coaxially aligned with a rear end wall opening 17. A guide tube 16 is directed coextensively between the first end opening 15 and the rear end wall opening 17. A lever 19 is mounted within the first hull 13 about a lever axle 20 between the top wall 14 and the guide tube 16 in adjacency to the rear end wall opening 17. The lever 19 includes a first end plate 21 oriented above the rear end wall opening 17, with the lever 19 directed through the first hull 13 terminating in a lever second end lug 24 that is spring-biased into a guide tube slot 18 by a lever spring plate 25, that in turn is mounted to the guide tube 16. The lever second end lug 24 is arranged for engagement with one of a plurality of projectile annular recesses 23 of a projectile 22 slidably received within the guide tube 16. Selection of one of the annular recesses 23 permits selective tensioning of an associated ejector plate spring 28, wherein the projectile 22 abuts upon the ejector plate 26, that in turn includes an ejector plate rod 27 coaxially oriented relative to the guide tube 16 and extending through the rear end wall opening 17, as indicated in FIG. 3 for example. Lifting of the second end lug 24 from the annular recess 23 releases spring tension imposed upon the spring 28 by initial directing of the projectile 22 into engagement with the ejector plate 26 and compressing the spring 28. In this manner, the projectile 22 is directed from the first hull 13 towards the second boat member 12. The first hull top wall 14 includes a first housing 29 having a first window 30 orthogonally oriented relative to the first hull top wall 14. The first housing 29 includes a first housing second window directed into the first housing orthogonally oriented relative to the first window, with a mirror 31 oriented at a substantial forty-five degree angle relative to the first and second windows 30 and 32 to permit viewing and alignment of the guide tube 16 by peering through the second window into the mirror 31 to view through the first window 30 in this manner aligning the target plate 36 with the guide tube 16 and the projectile 22.

The second hull 33 includes a second hull top wall 34 and a second hull side wall structure 35, with the target plate 36 arranged in a spaced relationship relative to the second hull side wall 35. A column of stacked plates 37 define a second housing on the second hull 33. The stacked plates 37 are ejected from the second hull top wall 34 upon impact of the target plate 36 by the projectile 32, in a manner to be described in more detail below.

The cam shaft 38 is pivotally mounted within the second hull 33 between the side walls 35, with a cam shaft coil spring 39 secured to the cam shaft 38 and to the hull, whereupon the rotative displacement of a cam plate 40 mounted to the cam shaft 38 effects winding of the coil spring 39. The cam plate 40 includes a cam plate hook 46 arranged for engagement about a piston shaft 41 that is parallel to and adjacent the cam shaft 38. The piston shaft 41 at its first end mounts the target plate 36, wherein at its second end, a piston 43 is mounted received within a piston chamber 44. A chamber chimney conduit 45 is directed from the piston chamber 44 to the second hull top wall 34, with a powder positioned within the piston chamber 44 that is displaced with the chimney conduit 45 upon impact of the target plate 42 and compression of a target plate spring 42 interposed between the target plate 36 and an adjacent side wall 35. Simultaneously, the piston shaft 41 is displaced to align a piston shaft recess 47 with the cam plate hook 46 to release the cam plate hook 46 and permit rotation of the cam plate 40 and associated displacement of the column of stacked plates 37 as the cam plate 40 is projected through a second hull top wall opening 48.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A naval battle toy apparatus, comprising, a first boat member in cooperation with a second boat member, wherein the first boat member includes an elongate first hull, the second boat member having an elongate second hull, the first hull having a first hull top wall, and the first hull further including a first end opening and a second end opening, wherein the first end opening and the second end opening are coaxially aligned, and a guide tube directed coextensively between the first end opening and the second end opening, and the guide tube having a guide tube slot directed into the guide tube, and a guide tube lever, the lever having a lever axle, the lever axle positioned within the first hull between the guide tube and the first hull top wall, the first lever axle having a first end plate positioned exteriorly of the first hull, and the lever having a second end lug mounted to the lever positioned within the hull, wherein the second end lug is arranged for reception within the guide tube slot, and a projectile received within the guide tube, the projectile including an annular recess, wherein the second end lug is received within the annular recess, wherein the lever is arranged for pivoting about the lever axle to permit displacement of the second end lug relative to the annular recess, and spring plate means mounted within the guide tube for effecting projection of the projectile from the guide tube upon displacement of the second end lug relative to the annular recess, and the spring plate means includes an ejector plate mounted within the guide tube, the ejector plate including an ejector plate rod slidably directed through the guide tube coaxially aligned therewith, and slidably directed through the second end wall opening, and an ejector spring wound about the ejector plate rod between the ejector plate and the hull within the guide tube, and the apparatus further including a spring plate fixedly mounted to the guide tube biasing the second end lug into engagement with the guide tube slot and the annular recess, and a first boat member housing mounted to the first hull top wall, with the first boat member housing including a first window orthogonally oriented relative to the first hull top wall, and the first boat member housing including a second window orthogonally oriented relative to the first window, and a mirror positioned within the first boat member housing permitting viewing through the first window upon an individual peering into the second window, and the second boat member includes a second hull, the second hull having a second hull top wall, and the second hull having second hull side walls, with a target plate mounted in adjacency to one of the second hull side walls, the target plate having a piston shaft projected through the second hull side walls, with a target plate spring interposed between the target plate and an adjacent one of said second hull side walls, and the target plate mounted to a first end of the piston shaft, and a piston mounted to a second end of the piston shaft, and a piston chamber positioned within the second hull, with the piston directed into the piston chamber, a powder positioned within the piston chamber, and a chamber chimney conduit directed from the piston chamber through the second hull top wall, whereupon compression of the powder within the piston chamber effects projection of the powder through the chimney conduit.

2. An apparatus as set forth in claim 1 including a column of stacked plate members mounted upon the second hull top wall, and the second hull top wall including a second hull top wall opening positioned below the plate members, and a cam shaft parallel to and spaced relative to the piston shaft, with the cam shaft including a cam plate fixedly mounted to the cam shaft, and a cam shaft coil spring mounted to the cam shaft and to the second hull, and the cam plate having a cam plate hook, the cam plate hook arranged for engagement with the piston shaft, and release means for permitting release of the cam plate hook relative to the piston shaft.

3. An apparatus as set forth in claim 2 wherein the release means includes a piston shaft recess directed into the piston shaft, and upon axial displacement of the piston shaft effects positioning of the cam plate hook within the piston shaft recess to permit release of the cam plate.

* * * * *